US008377266B2

(12) United States Patent
Kagawa

(10) Patent No.: US 8,377,266 B2
(45) Date of Patent: Feb. 19, 2013

(54) ELECTRIC CORROSION PREVENTING STRUCTURE OF MARINE VESSEL PROPELLING MACHINE

(75) Inventor: Atsushi Kagawa, Haga-gun (JP)

(73) Assignee: Showa Corporation, Saitama (JP)

( * ) Notice: Subject to any disclaimer, the term of this patent is extended or adjusted under 35 U.S.C. 154(b) by 132 days.

(21) Appl. No.: 13/045,616

(22) Filed: Mar. 11, 2011

(65) Prior Publication Data

US 2012/0073961 A1 Mar. 29, 2012

(30) Foreign Application Priority Data

Sep. 28, 2010 (JP) ..... 2010-217933

(51) Int. Cl.

| | |
|---|---|
| ***C23F 13/06*** | (2006.01) |
| ***C23F 13/08*** | (2006.01) |
| ***C23F 13/12*** | (2006.01) |
| ***C23F 13/14*** | (2006.01) |
| ***C23F 13/16*** | (2006.01) |

(52) U.S. Cl. ..... 204/196.37; 204/196.17; 204/196.3; 204/196.31; 440/61 T; 440/61 D; 440/61 F; 440/61 G; 440/76; 440/77; 440/78

(58) Field of Classification Search ..... 204/196.17, 204/196.3, 196.31, 196.37; 440/61 T, 61 D, 440/61 F, 61 G, 76, 77, 78
See application file for complete search history.

(56) References Cited

U.S. PATENT DOCUMENTS

| | | | | |
|---|---|---|---|---|
| 4,781,634 | A * | 11/1988 | Harris et al. | 440/66 |
| 5,716,248 | A * | 2/1998 | Nakamura | 440/76 |
| 5,886,617 | A * | 3/1999 | Meloche et al. | 338/176 |
| 5,890,227 | A * | 4/1999 | Brown | 2/102 |
| 2005/0284714 | A1 * | 12/2005 | Lun et al. | 188/267 |

FOREIGN PATENT DOCUMENTS

| | | |
|---|---|---|
| JP | 2005-329828 | 12/2005 |

* cited by examiner

*Primary Examiner* — Bruce Bell
(74) *Attorney, Agent, or Firm* — Babcock IP, PLLC

(57) ABSTRACT

In a electric corrosion preventing structure of a marine vessel propelling machine, a cylinder is integrally formed in a cylinder block, an electric connection portion is provided in a portion in which a rod guide is fixed to the cylinder, an electric connection portion is provided in a portion in which a piston is fixed to a rod in an inner portion of the cylinder, and the piston fixed to the rod strikes against the rod guide in an electrically connected state, at a maximum extension when the rod protrudes out of the cylinder.

16 Claims, 4 Drawing Sheets

ELECTRIC CORROSION PREVENTING STRUCTURE OF MARINE VESSEL PROPELLING MACHINE

BACKGROUND OF THE INVENTION

1. Field of the Invention

The present invention relates to an electric corrosion preventing structure of a marine vessel propelling machine such as an outboard motor or the like.

2. Description of the Related Art

The marine vessel propelling machine of the outboard machine or the like is structured such that a propelling unit is tiltably coupled to a stern bracket fixed to a marine vessel via a swivel bracket, a tilting cylinder apparatus is interposed between the stern bracket and the swivel bracket, the tilting cylinder apparatus integrally forms a cylinder in a cylinder block, a rod slidably coupled to a rod guide fixed to the cylinder is inserted to an oil chamber in an inner portion of the cylinder, and a piston is fixed to an insertion end of the rod to the cylinder.

The tilting cylinder apparatus is provided with a tilt cylinder and a trim cylinder in the cylinder block, and actuates the propelling unit so as to tilt or trim. The tilt actuation by the tilt cylinder tilts the propelling unit within a tilt region against its own weight when a marine vessel is stopped, for raising the propelling unit above the water surface. The trim actuation by the trim cylinder tilts the propelling unit against a propelling force of a propeller within a trim region which has a smaller tilt angle than the tilt region, to adjust a cruising attitude of the marine vessel when the marine vessel is cruising.

In the marine vessel propelling machine mentioned above, since each of members of the marine vessel propelling machine is constructed of several different types of metal materials, an electrical potential difference is generated due to the metal material of each of the members coming into contact with sea water. The metal which has the higher ionization tendency is dissolved into the sea water, an effect known as electric corrosion.

Accordingly, in a conventional marine vessel propelling machine, as described in Japanese Unexamined Patent Publication No. 2005-329828 (patent document 1), in order to prevent the electric corrosion mentioned above, a metal such as a zinc or the like having a greater ionization tendency than a main material such as iron, aluminum alloy or the like of each of the members is provided as a sacrificial electrode (or a sacrificial anode, hereinafter, referred to as anode), and the anode is provided in a sea water contact portion of the propelling unit or the like, thereby preventing a corrosion of each of the other members.

However, in the conventional marine vessel propelling machine, the tilt cylinder and the trim cylinder which construct the tilting cylinder apparatus, particularly the trim rod of the trim cylinder is difficult to electrically connect to the anode provided in the propelling unit or the like, and electric corrosion is often generated. If the trim rod is not electrically connected to the anode, the anode can not be the sacrificial electrode for the trim rod.

For example, when the trim rod is constructed of an iron based material, a surface of the iron based material may appear uniform at first glance. However, the surface exhibits a different chemical component, structure, crystal orientation, oxide film, attachment or the like when observed by a microscope. A difference of electric potential is generated locally by this unevenness. In the case that the sea water comes into contact with the surface of the iron based material, an electric current flows from a higher electric potential to a lower electric potential in the iron based material, and flows from the lower electric potential to the higher electric potential in the sea water, and an ionization of the iron is generated in the portion having the lower electric potential. As a result, the portion having the lower electric potential corrodes in the surface of the trim rod.

SUMMARY OF THE INVENTION

An object of the present invention is to prevent electric corrosion of a rod constructing a tilting cylinder apparatus, via a electric corrosion preventing structure of a marine vessel propelling machine.

In a first aspect of the invention, there is provided an electric corrosion preventing structure of a marine vessel propelling machine comprising: a stern bracket fixed to a marine vessel; a propelling unit tiltably coupled to the stern bracket via a swivel bracket; a tilting cylinder apparatus interposed between the stern bracket and the swivel bracket; the tilting cylinder apparatus integrally forming a cylinder in a cylinder block; a rod slidably supported to a rod guide coupled to the cylinder, the rod inserted to an oil chamber in an inner portion of the cylinder; a piston fixed to an insertion end of the rod to the cylinder; and an anode electrically connected to the cylinder block. The cylinder is integrally formed in the cylinder block, an electric interconnection of the rod guide and the cylinder is provided by the coupling of the rod guide to the cylinder, an electric interconnection of the piston and the rod is provided by the coupling of the piston to the rod in the inner portion of the cylinder. The piston coupled to the rod strikes against the rod guide in an electrically connected state, at a maximum extension when the rod protrudes out of the cylinder.

In a second aspect of the invention, there is provided the electric corrosion preventing structure of a marine vessel propelling machine as claimed in claim 1, wherein the tilting cylinder apparatus is constructed by integrally forming a trim cylinder in the cylinder block. An electric interconnection of the rod guide and the trim cylinder is provided by the coupling of the rod guide to the trim cylinder. An electric interconnection of the piston and a trim rod is provided by the coupling of the piston to the trim rod in an inner portion of the trim cylinder. A piston fixed to the trim rod strikes against the rod guide in an electrically connected state, at a maximum extension when the trim rod protrudes out of the trim cylinder.

In a third aspect of the invention, there is provided the electric corrosion preventing structure of a marine vessel propelling machine according to the first or second aspect, wherein in the case the rod guide has an electric insulating membrane surface treatment, a masking with respect to the surface treatment is applied to at least a part of a portion fixed to the cylinder, and at least a part of a portion against which the piston strikes, in the rod guide, does not have the electric insulating membrane applied thereto.

In a fourth aspect of the invention, there is provided the electric corrosion preventing structure of a marine vessel propelling machine according to the third aspect, wherein the rod guide is made of an aluminum alloy, and an alumite treatment is applied as the surface treatment thereto.

In a fifth aspect of the invention, there is provided the electric corrosion preventing structure of a marine vessel propelling machine according to the third aspect, wherein the masking is applied to a thread portion which is screw attached to an opening portion of the cylinder, and an end surface which faces to an oil chamber within the cylinder.

In a sixth aspect of the invention, there is provided the electric corrosion preventing structure of a marine vessel propelling machine according to any one of first to fifth aspects, wherein the masking is applied to a thread portion which is screw attached to an opening portion of the cylinder, and an end surface which faces to an oil chamber within the cylinder.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings:

FIGS. 4A and 4B show a rod guide, in which FIG. 4A is a cross sectional view and FIG. 4B is a plan view.

DESCRIPTION OF THE PREFERRED EMBODIMENTS

Figure 1:
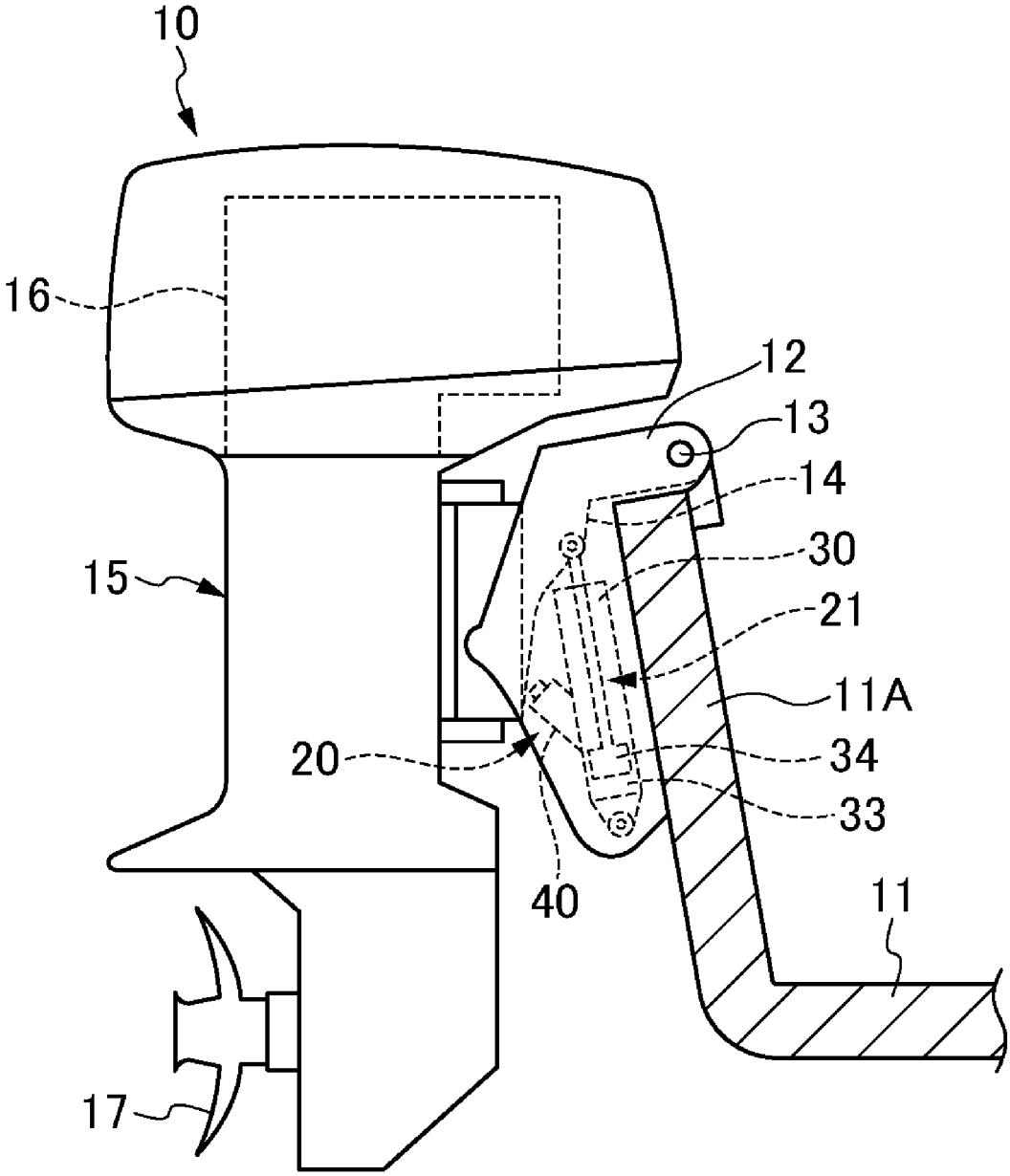
FIG. 1 is a schematic view showing a marine vessel propelling machine.

A marine vessel propelling machine 10 (an outboard motor, which may be constructed by an inboard-outboard engine, in this case) is structured, as shown in FIG. 1, such that a stern bracket 12 is fixed to a stern plate 11A of a marine vessel 11, and a swivel bracket 14 is pivoted to the stern bracket 12 tiltable approximately around a horizontal axis via a tilt shaft 13. A propelling unit 15 is rotatably pivoted to the swivel bracket 14 via a steering shaft which is not illustrated and is arranged approximately vertical so as to be rotatable around the steering shaft. An engine unit 16 is mounted to an upper portion of the propelling unit 15, and a propeller 17 is provided in a lower portion of the propelling unit 15.

In other words, the marine vessel propelling machine 10 is structured such that the propelling unit 15 is tiltably supported to the stern bracket 12 fixed to the marine vessel 11, via the tilt sh0aft 13 and the swivel bracket 14, a tilting cylinder apparatus 20 is interposed between the stern bracket 12 and the swivel bracket 14, and the propelling unit 15 can be tilted by expanding and contracting the tilting cylinder apparatus 20, by controlling the supply or discharge of a working fluid to or from the tilting cylinder apparatus 20 by means of a working fluid supply and discharge apparatus 50.

Figure 2:
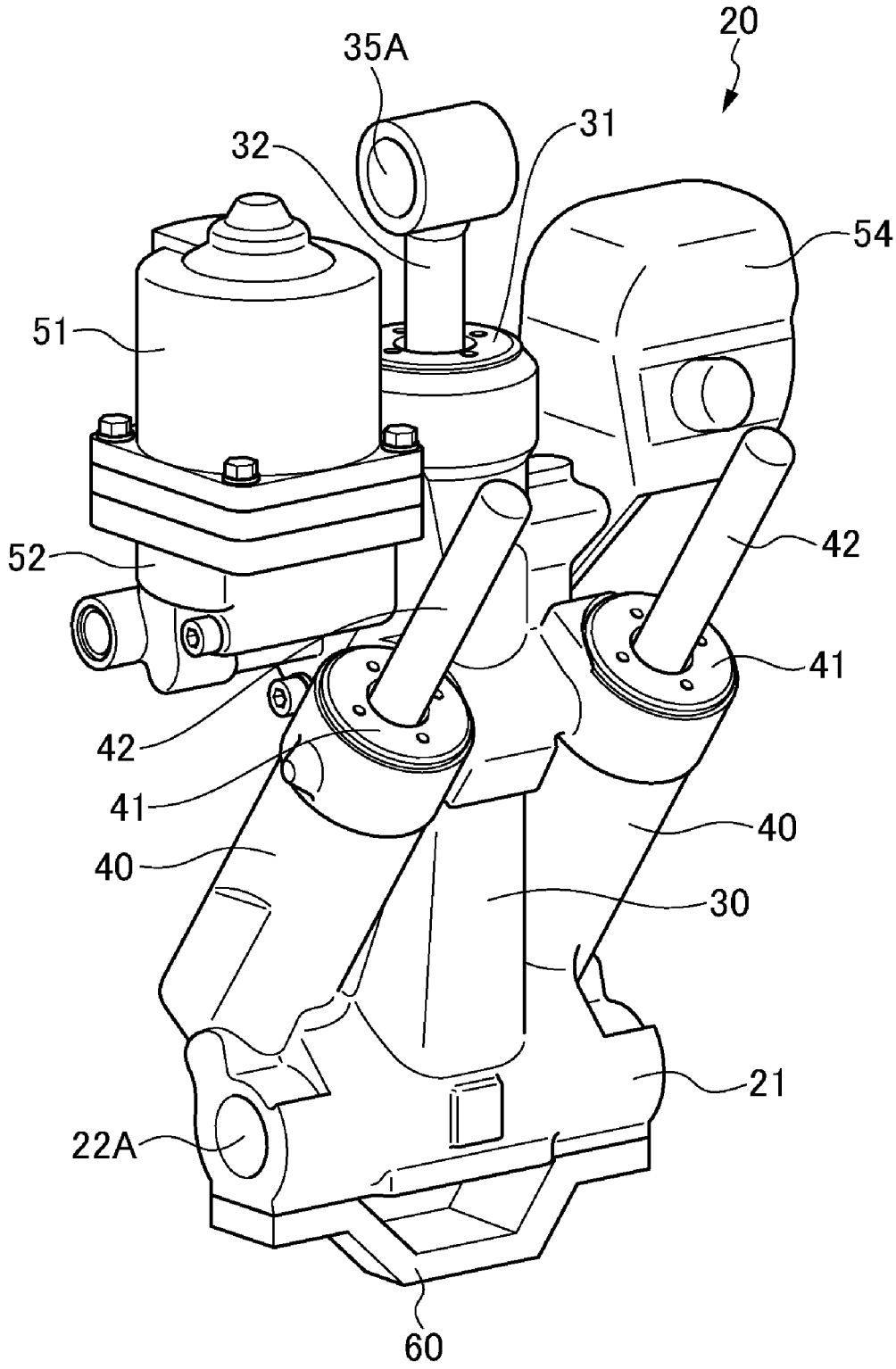
FIG. 2 is a perspective view showing a tilting cylinder apparatus.
Figure 3:
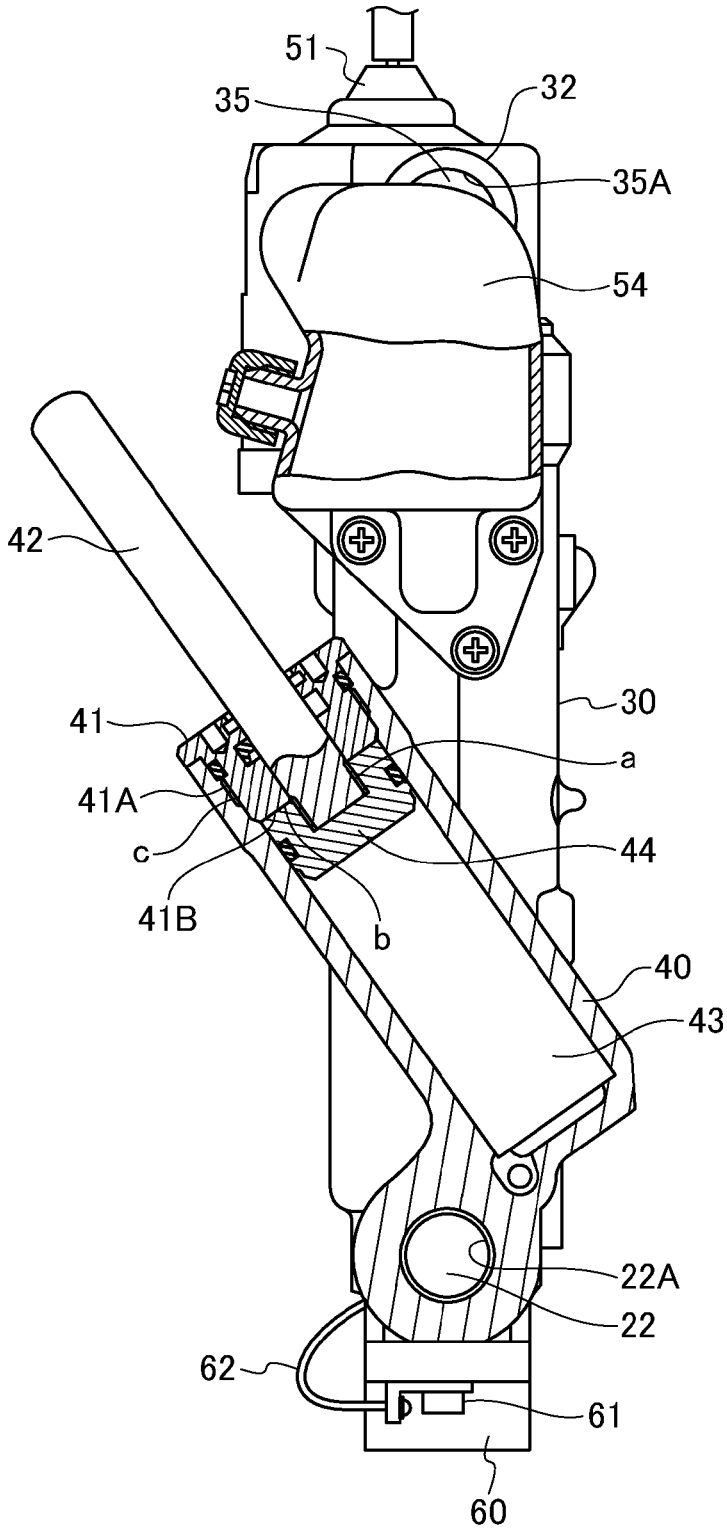
FIG. 3 is a side cross sectional view showing the tilting cylinder apparatus.
Figure 4A:
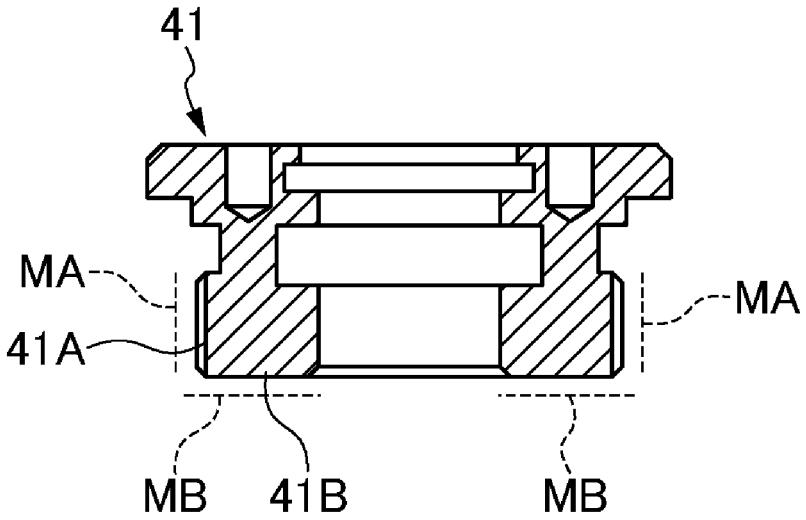
Figure 4B:
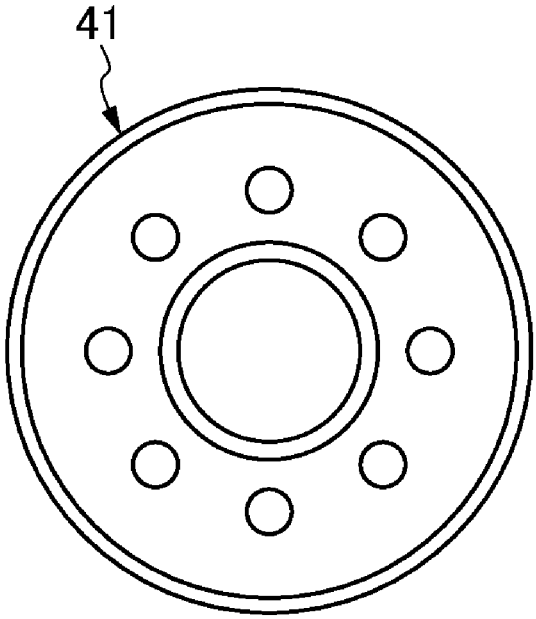

(Tilting Cylinder Apparatus 20) (FIGS. 2 and 3)

The tilting cylinder apparatus 20 is integrally provided with a center tilt cylinder 30 and a pair of right and left trim cylinders 40, in a cylinder block 21, as shown in FIGS. 2 and 3. The cylinder block 21 is provided with an attaching pin insertion hole 22A to the stern bracket 12, and pivotally attaches the stern bracket 12 and the cylinder block 21 by an attaching pin 22.

The tilting cylinder apparatus 20 is structured such that a tilt rod 32 slidably supported by a rod guide 31 fixed to an opening portion of the tilt cylinder 30 is inserted to an oil chamber 33 (not shown) in an inner portion of the tilt cylinder 30, and a piston 34 (not shown) is coupled to an insertion end of the tilt rod 32 to the tilt cylinder 30. The tilt rod 32 is provided with an attaching pin insertion hole 35A in the swivel bracket 14, and pivotally attaches the swivel bracket 14 and the tilt rod 32 via an attaching pin 35.

The tilting cylinder apparatus 20 is structured such that a trim rod 42 slidably supported to a rod guide 41 fixed to an opening portion of the trim cylinder 40 is inserted to an oil chamber 43 of the trim cylinder 40, and a piston 44 is fixed to an insertion end of the trim rod 42 to the trim cylinder 40. The trim rod 42 can be driven into contact with the swivel bracket 14 and can be separated therefrom by extension and retraction of the piston 44 within the trim cylinder 40.

The cylinder block 21 (including the tilt cylinder 30 and the trim cylinder 40) is constructed by applying an alumite treatment to an aluminum alloy (for example, AC4C or the like). The rod guides 31 and 41 are constructed by applying an alumite treatment to an aluminum alloy (for example, A6061-T6 or the like). The tilt rod 32 and the trim rod 42 are constructed by applying a Cr plating treatment to an iron based material (for example, SUS304 or the like). In this case, the alumite forms an electric insulating membrane.

(Working Fluid Supply and Discharge Apparatus 50) (FIGS. 2 and 3)

The working fluid supply and discharge apparatus 50 has a motor 51 and a tank 52, connected by a bolt to a manifold forming the tank 52 to the cylinder block 21, and incorporates a pump 53 (not shown) in an inner portion of the tank 52, as shown in FIGS. 2 and 3. Further, a reservoir tank 54 is coupled by a bolt to the cylinder block 21. The working fluid sucked by the pump 53 which is rotated forward and backward by the motor 51 from the tank 52 can be pressure fed to each of the oil chambers of the tilt cylinder 30 and the trim cylinder 40 of the tilting cylinder apparatus 20.

A description will be given below of a trim actuation and a tilt actuation of the tilting cylinder apparatus 20.

(A) Trim Actuation (Trim Up)

If the pump 53 is rotated backward by the motor 51, the discharge fluid of the pump 53 is supplied to a lower chamber of the tilt cylinder 30 to extend the tilt rod 32, and the discharge fluid of the pump 53 is supplied to a lower chamber of the trim cylinder 40 to bring the trim rod 42 into collision contact with the swivel bracket 14, whereby the swivel bracket 14 and the propelling unit 15 is trimmed up within the trim region.

(Trim Down)

If the pump 53 is rotated forward by the motor 51 when the propelling unit 15 is within the trim region, the discharge fluid of the pump 53 is supplied to an upper chamber of the tilt cylinder 30 to contract the tilt rod 32, and the discharge fluid of the pump 53 is supplied to an upper chamber of the trim cylinder 40 to contract the trim rod 42 while contacting the swivel bracket 14, whereby the swivel bracket 14 and the propelling unit 15 are trimmed down.

The propelling unit 15 is trimmed up and down within the trim region as mentioned above, and a cruising attitude of the marine vessel 11 is adjusted.

(B) Tilt Actuation (Tilt Up)

After the propelling unit 15 gets over a maximum trim up position on the basis of the trim actuation mentioned above which reversely rotates the pump 53 by the motor 51, only the tilt rod 32 of the tilt cylinder 30 extends at a higher speed, and the swivel bracket 14 and the propelling unit 15 tilts up to a maximum tilt up position within the tilt region getting over the trim region, leaving the trim rod 42 at the maximum extension position.

(Tilt Down)

When the pump 53 is forward rotated by the motor 51 in the case that the propelling unit 15 is within the tilt region, the tilt rod 32 of the tilt cylinder 30 contracts, and the swivel bracket 14 and the propelling unit 15 tilt down within the tilt region. After the swivel bracket 14 comes into collision with the trim rod 42 in the process of the tilt down of the propelling unit 15, the propelling unit 15 enters into the trim region, the trim rod 42 is contracted together with the tilt rod 32, and the swivel bracket 14 and the propelling unit 15 are trimmed down.

Accordingly, in the marine vessel propelling machine 10, in order to prevent the electric corrosion of the trim rod 42, even if the trim rod 42 protruding out of the trim cylinder 40 comes into contact with the sea water under the tilt actuation mentioned above of the tilting cylinder apparatus 20, the following structure is provided.

First of all, in the case that the rod guide 41 of the trim rod 42 has the electric insulating membrane applied via the alumite surface treatment, the following masking is applied. In other words, in the rod guide 41, a masking MA with respect to the alumite treatment is applied to at least a part of the portion coupled to the trim cylinder 40, a thread portion 41A screwed to an opening portion of the trim cylinder 40 in the present embodiment, and the electric insulating membrane is not applied thereto. Further, in the rod guide 41, a masking MB with respect to the alumite treatment is applied to at least a part of the portion against which the piston 44 fixed to the trim rod 42 strikes, an end surface 41B facing to an oil chamber within the trim cylinder 40 in the present embodiment, and the electric insulating membrane is not applied thereto at the maximum extension when the trim rod 42 protrudes out of the trim cylinder 40.

Further, each of the members of the marine vessel propelling machine 10 is assembled as mentioned below.

(1) The piston 44 is fixed to the end portion of the trim rod 42 in accordance with a screw attachment or the like. The rod guide 42 is constructed by applying the Cr plating to the iron based material (for example, SUS304 or the like), and the piston 44 is also constructed of the iron based material which is not surface treated. Further, the portions in which the piston 44 is fixed to the trim rod 42 in the inner portion of the trim cylinder 40, the screw attached portions of the both in the present embodiment electrically come into contact with each other, whereby an electric interconnection, indicated on FIG. 3 as "a", is provided.

(2) At the maximum extension when the trim rod 42 protrudes out of the trim cylinder 40, the end surface of the iron based material which is not surface treated, of the piston 44 fixed to the trim rod 42 strikes against the end surface 41B of the rod guide 41. Since the end surface 41B is applied the masking MB mentioned above, the piston 44 fixed to the trim rod 42 comes into electric contact with the rod guide 41 at the maximum extension when the trim rod 42 protrudes out of the trim cylinder 40, whereby an electric interconnection, indicated on FIG. 3 as "b", is provided.

(3) The thread portion 41A of the rod guide 41 slidably supporting the trim rod 42 is screw attached to the opening portion of the trim cylinder 40 so as to be fixed. Since the thread portion 41A is applied the masking MA mentioned above, the portions in which the rod guide 41 is fixed to the trim cylinder 40, the screw attached portions of the both in the present embodiment come into electric contact with each other, whereby an electric interconnection, indicated on FIG. 3 as "c", is provided.

(4) An anode 60, for example, made of a zinc is fixed to the lower portion of the cylinder block 21 (in which the trim cylinder 40 is integrally formed) by a bolt 61, and the anode 60 is arranged in a sea water contact portion. The cylinder block 21 and the anode 60 are electrically connected by a lead wire 62. In this case, the anode 60 may be structured coupled to the propelling unit 15, and be electrically connected to the cylinder block 21 via the propelling unit 15.

In accordance with the items (1) to (4) mentioned above, the trim rod 42 is electrically connected to the cylinder block 21 in which the trim cylinder 40 is integrally formed, via the piston 44 having the electric interconnection "a" with the trim rod 42, the rod guide 41 having the electric interconnection "b" with the piston 44, and the trim cylinder 40 having the electric interconnection "c" with the rod guide 41, and is further electrically connected to the anode 60 via the cylinder block 21 and the lead wire 62. Accordingly, the electric corrosion of the trim rod 42 is prevented under the tilt actuation of the marine vessel propelling machine 10.

In this case, since under the trim actuation of the marine vessel propelling machine 10, the trim rod 42 comes into collision contact with the swivel bracket 14 so as to be electrically connected to the swivel bracket 14, and the trim rod 42 is electrically communicated with the anode which is electrically connected to the swivel bracket 14 (which may be the anode fixed to the swivel bracket 14, the propelling unit 15 or the like, or the anode 60 fixed to the cylinder block 21 in accordance with the present embodiment), electric corrosion of the trim rod 42 is prevented.

In the marine vessel propelling machine 10, in the case that the rod guide 31 of the tilt cylinder 30 is alumite treated, the piston 34 of the tilt rod 32 is not electrically connected to the cylinder block 21, and the attaching pin 35 pivotally attached portion of the tilt rod 32 and the swivel bracket 14 is not electrically connected, the present invention can be applied. In other words, the masking with respect to the alumite treatment may be applied to the fixed portion of the rod guide 31 to the tilt cylinder 30 and the striking portion of the rod guide 31 to the piston 34. The electric connection portion is provided in the fixed portion between the rod guide 31 and the tilt cylinder 30, and the electric connection portion is provided in the striking portion between the rod guide 31 and the piston 34.

In accordance with the present embodiment, the following operations and effects can be achieved.

(a) In the tilt cylinder 30 or the trim cylinder 40 constructing the tilting cylinder apparatus 20, for example, the trim cylinder 40, the structure is made such that the trim cylinder 40 is integrally formed in the cylinder block 21, the electric interconnection "c" is provided in the portion in which the rod guide 41 is fixed to the trim cylinder 40, the electric interconnection "a" is provided in the portion in which the piston 44 is coupled to the trim rod 42 in the inner portion of the trim cylinder 40, and the piston 44 fixed to the trim rod 42 strikes against the rod guide 41 in a state in which it is electrically connected thereto via the electric interconnection "b", at the maximum extension when the trim rod 42 protrudes out of the trim cylinder 40. Accordingly, the tilt rod 32 protruding out of the tilt cylinder 30 tilts the swivel bracket 14 to the maximum tilt up position, the trim rod 42 stays while protruding out of the trim cylinder 40 to the maximum extending position, the trim rod 42 is electrically connected to the cylinder block 21 via the piston 44, the rod guide 41 and the trim cylinder 40 mentioned above, under the tilt actuation of being away from the swivel bracket 14. Therefore, even if the sea water comes into contact with the trim rod 42 protruding out of the trim cylinder 40 under the tilt actuation, the trim rod 42 energizes the anode 60 which is electrically connected to the cylinder block 21 mentioned above. The anode 60 is provided, for example, in the sea water contact portion below the cylinder block 21, and when both of the anode 60 and the trim rod 42 come into contact with the sea water, the anode 60 having the greater ionization tendency than the constructing material of the trim rod 42 is ionized so as to dissolve into the sea water, whereby it is possible to prevent the electric corrosion of the trim rod 42.

(b) In the case that the rod guide 41 is made of the aluminum alloy or the like, and is applied the electric insulating membrane on the basis of the surface treatment such as the alumite treatment or the like, the masking MA and MB with respect to the surface treatment is applied to at least a part of the portion which is fixed to the trim cylinder 40, and at least a part of the portion against which the piston 44 strikes, in the rod guide 41, whereby the electric insulating membrane is not applied thereto. Accordingly, even in the case that the rod guide 41 has the surface treatment such as the alumite treatment or the like applied, the trim rod 42 can be electrically connected to the cylinder block 21 via the piston 44, the rod guide 41 and the trim cylinder 40 as mentioned in the item (a).

As heretofore explained, embodiments of the present invention have been described in detail with reference to the drawings. However, the specific configurations of the present invention are not limited to the illustrated embodiments but those having a modification of the design within the range of the presently claimed invention are also included in the present invention.

The present invention is structured such that in the electric corrosion preventing structure of the marine vessel propelling machine in which the propelling unit is supported to the stern bracket fixed to the marine vessel via the swivel bracket so as to be tiltable, the tilting cylinder apparatus is interposed between the stern bracket and the swivel bracket, the tilting cylinder apparatus integrally forms the cylinder in the cylinder block, the rod slidably supported to the rod guide fixed to the cylinder is inserted to the oil chamber in the inner portion of the cylinder, the piston is fixed to the insertion end of the rod to the cylinder, and the anode is electrically connected to the cylinder block, the cylinder is integrally formed in the cylinder block, the electric connection portion is provided in the portion in which the rod guide is fixed to the cylinder, the electric connection portion is provided in the portion in which the piston is fixed to the rod in the inner portion of the cylinder, and the piston coupled to the rod strikes against the rod guide in the electrically connected state, at the maximum extension when the rod protrudes out of the cylinder. Accordingly, it is possible to prevent the electric corrosion of the rod constructing the tilting cylinder apparatus, in the electric corrosion preventing structure of the marine vessel propelling machine.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be encompassed within a scope of equivalents thereof with respect to the features set out in the appended aims.

What is claimed is:

1. An electric corrosion preventing structure of a marine vessel propelling machine comprising:

a stern bracket fixed to a marine vessel;

a propelling unit tiltably coupled to the stern bracket via a swivel bracket;

a tilting cylinder apparatus interposed between the stern bracket and the swivel bracket;

the tilting cylinder apparatus integrally forming a cylinder in a cylinder block;

a rod slidably supported to a rod guide coupled to the cylinder, the rod inserted to an oil chamber in an inner portion of the cylinder;

a piston fixed to an insertion end of the rod to the cylinder; and an anode electrically connected to the cylinder block, wherein the cylinder is integrally formed in the cylinder block, an electric interconnection of the rod guide and the cylinder is provided by the coupling of the rod guide to the cylinder, an electric interconnection of the piston and the rod is provided by the coupling of the piston to the rod in the inner portion of the cylinder, and the piston coupled to the rod strikes against the rod guide in an electrically connected state, at a maximum extension when the rod protrudes out of the cylinder.

2. The electric corrosion preventing structure of a marine vessel propelling machine as claimed in claim 1, wherein the tilting cylinder apparatus is constructed by integrally forming a trim cylinder in the cylinder block, wherein an electric interconnection of the rod guide and the trim cylinder is provided by the coupling of the rod guide to the trim cylinder, an electric interconnection of the piston and a trim rod is provided by the coupling of the piston to the trim rod in an inner portion of the trim cylinder, and a piston fixed to the trim rod strikes against the rod guide in an electrically connected state, at a maximum extension when the trim rod protrudes out of the trim cylinder.

3. The electric corrosion preventing structure of a marine vessel propelling machine as claimed in claim 2, wherein the rod guide has an electric insulating membrane surface treatment, on at least a part of a portion fixed to the cylinder, and at least a part of a portion against which the piston strikes, in the rod guide, does not have the electric insulating membrane.

4. The electric corrosion preventing structure of a marine vessel propelling machine as claimed in claim 3, wherein the rod guide is made of an aluminum alloy, and an alumite treatment is the electric insulating membrane surface treatment.

5. The electric corrosion preventing structure of a marine vessel propelling machine as claimed in claim 4, wherein the anode is made of a zinc, and the anode is fixed to a lower portion of the cylinder block by a bolt.

6. The electric corrosion preventing structure of a marine vessel propelling machine as claimed in claim 3, wherein the electric insulating membrane surface treatment is not on a thread portion which is screw attached to an opening portion of the cylinder, and an end surface which faces to an oil chamber within the cylinder.

7. The electric corrosion preventing structure of a marine vessel propelling machine as claimed in claim 6, wherein the anode is made of a zinc, and the anode is fixed to a lower portion of the cylinder block by a bolt.

8. The electric corrosion preventing structure of a marine vessel propelling machine as claimed in claim 3, wherein the anode is made of a zinc, and the anode is fixed to a lower portion of the cylinder block by a bolt.

9. The electric corrosion preventing structure of a marine vessel propelling machine as claimed in claim 2, wherein the anode is made of a zinc, and the anode is fixed to a lower portion of the cylinder block by a bolt.

10. The electric corrosion preventing structure of a marine vessel propelling machine as claimed in claim 1, wherein the rod guide has an electric insulating membrane surface treatment, on at least a part of a portion fixed to the cylinder; and at least a part of a portion against which the piston strikes, in the rod guide, does not have the electric insulating membrane.

11. The electric corrosion preventing structure of a marine vessel propelling machine as claimed in claim 10, wherein the rod guide is made of an aluminum alloy, and an alumite treatment is the electric insulating membrane surface treatment.

12. The electric corrosion preventing structure of a marine vessel propelling machine as claimed in claim 11, wherein the anode is made of a zinc, and the anode is fixed to a lower portion of the cylinder block by a bolt.

13. The electric corrosion preventing structure of a marine vessel propelling machine as claimed in claim 10, wherein the electric insulating membrane surface treatment is not on a thread portion which is screw attached to an opening portion of the cylinder, and an end surface which faces to an oil chamber within the cylinder.

14. The electric corrosion preventing structure of a marine vessel propelling machine as claimed in claim 13, wherein the anode is made of a zinc, and the anode is fixed to a lower portion of the cylinder block by a bolt.

15. The electric corrosion preventing structure of a marine vessel propelling machine as claimed in claim 10, wherein the anode is made of a zinc, and the anode is fixed to a lower portion of the cylinder block by a bolt.

16. The electric corrosion preventing structure of a marine vessel propelling machine as claimed in claim 1, wherein the anode is made of a zinc, and the anode is fixed to a lower portion of the cylinder block by a bolt.

* * * * *